US005816836A

United States Patent [19]

Snow et al.

[11] Patent Number: 5,816,836

[45] Date of Patent: Oct. 6, 1998

[54] HIGH DENSITY HIGH PERFORMANCE CONNECTOR

[75] Inventors: Richard Snow, Brighton; Tim Pickles, Aurora, both of Colo.

[73] Assignee: Krone AG, Berlin-Zehlendorf, Germany

[21] Appl. No.: 651,414

[22] Filed: May 22, 1996

[51] Int. Cl.[6] ..... H01R 13/02

[52] U.S. Cl. ..... 439/225; 439/215; 439/189; 439/289

[58] Field of Search ..... 439/295, 284, 439/266, 269.1, 269.2, 189, 912, 957, 225, 717, 701, 417, 404, 465, 406, 289

[56] References Cited

U.S. PATENT DOCUMENTS

| | | | |
|---|---|---|---|
| 3,638,164 | 1/1972 | Glance et al. . | |
| 4,153,326 | 5/1979 | Frantz et al. | 439/465 |
| 4,349,239 | 9/1982 | Roberts et al. . | |
| 4,382,648 | 5/1983 | Propst et al. . | |
| 4,781,609 | 11/1988 | Wilson et al. | 439/210 |
| 4,795,356 | 1/1989 | Pauza | 439/225 |
| 4,898,549 | 2/1990 | Nakama et al. | 439/701 |
| 4,928,303 | 5/1990 | Allin et al. | 439/502 |
| 4,973,796 | 11/1990 | Dougherty et al. | 174/48 |
| 5,104,332 | 4/1992 | McCoy | 439/290 |
| 5,158,472 | 10/1992 | Juhlin | 439/215 |
| 5,160,276 | 11/1992 | Marsh et al. | 439/502 |
| 5,164,544 | 11/1992 | Snodgrass et al. | 439/215 |
| 5,171,159 | 12/1992 | Byrne | 439/215 |
| 5,186,640 | 2/1993 | McCoy | 439/211 |
| 5,203,711 | 4/1993 | Bogiel | 439/215 |
| 5,203,713 | 4/1993 | French et al. | 439/215 |
| 5,205,762 | 4/1993 | Carney | 439/607 |
| 5,214,889 | 6/1993 | Nienhuis et al. | 52/220.7 |
| 5,236,370 | 8/1993 | King et al. | 439/171 |
| 5,252,086 | 10/1993 | Russell et al. | 439/215 |
| 5,257,945 | 11/1993 | Heng et al. | 439/406 |
| 5,272,277 | 12/1993 | Humbles et al. | 439/502 |
| 5,277,609 | 1/1994 | Ondrejka | 439/215 |
| 5,318,454 | 6/1994 | Deer et al. | 439/215 |
| 5,336,097 | 8/1994 | Williamson, Jr. et al. | 439/94 |
| 5,349,135 | 9/1994 | Mollenkopf et al. | 174/48 |
| 5,431,573 | 7/1995 | Endo et al. | 439/157 |
| 5,431,578 | 7/1995 | Wayne | 439/259 |
| 5,431,584 | 7/1995 | Ferry | 439/620 |

FOREIGN PATENT DOCUMENTS

| | | |
|---|---|---|
| 2 583 929 - A1 | 12/1986 | France . |
| 2 595 011 - A1 | 8/1987 | France . |

*Primary Examiner*—Gary F. Paumen
*Attorney, Agent, or Firm*—McGlew and Tuttle

[57] ABSTRACT

A telecommunications and data connector with a connector first side assembly having a first side base portion formed of plastic and defining a plurality of grooves. The connector first side assembly also includes a first side plurality of contact elements. Each of the contacts extend from a wire end toward an assembly connection end. Each of the first side contact elements is movable between a contact position, and a non-contact position. A connector second side assembly is provided which is substantially identical to the connector first side assembly. The connector first side assembly and the connector second side assembly are connectable in a mated position wherein individual contact areas of the first side plurality of contacts make electrical contact with the corresponding individual contact areas of the second plurality of electrical contacts. The contact assemblies each include a hermaphroditic connector for coupling the assemblies together. A tap is insertable between the first side base portion and the second side base portion for tapping signals carried by one or more of the first side plurality of contacts.

23 Claims, 21 Drawing Sheets

HIGH DENSITY HIGH PERFORMANCE CONNECTOR

FIELD OF THE INVENTION

The present invention relates to connectors for communication cabling systems for use within buildings. The invention relates, more particularly, to an improved high density connector which is preferably used with office furniture such as interior space dividing wall panels to provide a plurality of communication links which are readily supplied to a plurality of work stations to permit the selection of links to take place at the work station, to facilitate voice and data transmission, including telephone systems and local area network systems and which also significantly simplifies both initial installation and reconfiguration.

BACKGROUND OF THE INVENTION

Companies using commercial space have increasingly used large open floor areas which are divided into offices (cubicals) and the like. The company occupying the commercial space typically determines the most efficient use of the floor space for its own needs and selects how the floor space is to be divided into smaller working areas through the use of portable wall panels and similar structures. So called "systems" furniture is used for dividing large floor spaces into smaller work areas (cubicals). This typically utilizes interior upright space-dividing panels which connect together, serially, through two panel straight or angled connections, or through suitable three- or four-panel connections to define a large plurality of individual work areas. Such panels are typically less than floor-to-ceiling height and cooperate with other furniture components to define an equipped work area.

Each work area must be supplied with adequate electrical power and communication cabling. Various systems and components have been developed including modular electrical systems which cooperate with and which readily mount on the panels. This allows the panels to be reconfigured and allows for the supply of power to the work areas.

Various systems have been proposed to avoid the use of a large number of conventional four pair communication cables, namely individual cables fed through floor conduits or ceiling clearance spaces to the various work areas. However, the various prior art systems have not met with great commercial acceptance or utilization. Examples of such prior art attempts include the systems and devices disclosed in U.S. Pat. Nos. 5,272,277; 5,160,276 and 4,928,303.

In the systems furniture field, aside from the few systems relating to communications, numerous systems relating to power are known in the art. A great deal of these systems deal with particular problems relating to power transmission and distribution with systems furniture.

U.S. Pat. No. 4,781,609 discloses a multicircuit electrical system which is used with wall panels. The electrical system is a seven conductor system employing three live and three neutral conductors for defining three separate electrical circuits each having a separate neutral. A portable power tap unit (a receptacle unit) can be plugged into the power block for selective engagement with any one of the three circuits. Although this system provides great advantages with regard to power and selecting one of the various circuits at the location, after the wall panels are put into place, using the tap feature, the system involves a great many components and is particular to the power distribution problem.

U.S. Pat. No. 5,236,370 discloses another electrical system for use with interior space dividing walls. The system is prefabricated and includes elongate harnesses mounted within channels which extend interiorly of the space-dividing members. Adjacent harnesses are electrically joined by flexible electrical jumpers which create plug like connections with power blocks. This system provides significant advantages as to ease of use. However, the system again includes numerous components which adds significant expense. Additionally, the system again includes features which are directed toward power distribution and problems associated with power distribution.

SUMMARY AND OBJECTS OF THE INVENTION

It is an object of the invention to provide a high density high performance connector for telecommunications and data applications, particularly for use with interior space-dividing systems, wherein the connector provides a good physical and electrical connection and allows for a simple tapping of signals on the connected wires.

It is another object of the invention to provide a high density high performance connector for telecommunications and data applications including a first connector part with a plurality of contacts and a second connector part with a plurality of contacts, the first connector part being mateable with the second connector part to provide physical and electrical connection between contacts of the first connector part with contacts of the second connector part and further including a tap which can be connected with the mated first connector part and second connector part without disconnecting (unmating) the first connector part and the second connector part wherein the tap interrupts the connection between some of the electrically and physically engaged contacts for tapping signals from contacts, without necessarily interrupting physical and electrical connection between other contacts of the mated first connector part and second connector part.

It is a further object of the invention to provide a high density high performance connector for telecommunications and data systems which involves a minimum number of parts, a minimum number of different types of parts and allows ease of use including flexibility as to the number of communication links as well as tap-off features allowing selection of links for tapping-off to selected workstations.

According to the invention, a telecommunications and data connector is provided with a connector first side assembly having a first side base portion formed of plastic. The connector first side assembly also includes a first side plurality of contact elements. Each of the contacts extend from a wire end toward an assembly connection end of the base portion. Each of the contact elements is movable between a contact position, and a non-contact position. Each of the first side contact elements includes wire electrical connector means for making an electrical connection with a wire. Each of the contacts also includes a contact area. A connector second side assembly is provided which is substantially identical to the connector first side assembly. The connector first side assembly and the connector second side assembly are connectable in a mated position wherein individual contact areas of the first side plurality of contacts make electrical contact with the corresponding individual contact areas of the second plurality of electrical contacts. The contact assemblies each include hermaphroditic connector means for coupling the assemblies together. A tap means is insertable between the first side base portion and the second side base portion for tapping signals carried by one or more of the first side plurality of contacts or second side plurality of contacts.

The tap means is provided as an elongate element which may be inserted between the connector assemblies. One side of the tap is preferably provided with contacts and the other side has an insulation material face. Each of the contacts is electrically connected to an insulation displacement contact for running wires to an end user.

Contact displacement means is provided for moving the contacts between the contact position and the non-contact position. The contact displacement means is associated with each contact assembly and with the tap. The contact assemblies each include a contact opening device (COD) which is itself displaceable and forms the base portion part of the contact displacement means. Ends of each contact are acted on by the COD which moves the contact between the contact position and the non-contact position. The tap means part of the contact displacement means includes a beveled tip which engages a COD.

The first side base portion hermaphroditic connection means is provided including a female connection part and a male connection part. The second side base portion hermaphroditic connection means is provided including a second side base portion female part and a second side base portion male part. The first side base portion connection part and the second side base portion connection part connect the first connection assembly and the second connection assembly in the mated position.

The first side plurality of contacts preferably include resilient means for supporting the contact area allowing the contact area to move between the contact position and the non-contact position. The tap means is inserted between the first side base portion and the second side base portion in the contact assembly mated position. The tap in an inserted state, maintains one set of contacts in the non-contact position such that the lines are dead (no signal) downstream of the tap.

The first side connector assembly further includes a strain relief element engaging the incoming wires for pressing the incoming wires to retain the incoming wires connected to the first side plurality of contacts of the connector first side assembly. The strain relief element further comprises a plurality of protruding elements for pressing corresponding incoming wires into IDC elements of the first plurality of contacts. The strain relief element preferably includes a snap connection element cooperating with a snap connection element of the first side base portion for fixing the strain relief element to the first side base portion.

The connector first side assembly further includes assembly stacking connection means including a male connection element attached to the strain relief element and a female connection element defined by the first side base portion. Another connector first side assembly may be provided connected to the connector first side assembly to form a first side stack of assemblies by connection of the connector first side assembly to the another connector first side assembly via the stacking connection means.

The connector second side assembly further includes a second side strain relief element. The second side strain relief element is substantially identical to the first side strain relief element. Another connector second side assembly may be provided which is substantially identical to the connector fist side assembly. Second side assembly stacking connection means is provided including a male connection element attached to the second side strain relief element and a female connection element defined by the second side base portion. The another connector second side assembly is stacked with the connector second side assembly to form a second side stack of assemblies via the second side assembly stacking means. The second side stack of assemblies is mated with the first side stack of assemblies.

Each of the first plurality of connectors and the second plurality of connectors are identical. The connectors each have a connector insulation displacement contact including a substantially U-shaped support defining a first wall and an opposite second wall. The first wall is connected to one insulation displacement contact portion and the second wall is connected to another, opposite insulation displacement contact portion. The U-shaped element is formed of resilient material for flexing to increase a distance between the first insulation displacement contact portion and the second insulation displacement contact portion allowing an insulated wire to be disposed between the first insulation displacement contact portion and the second insulation displacement contact portion for making contact with a wire core.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 2:
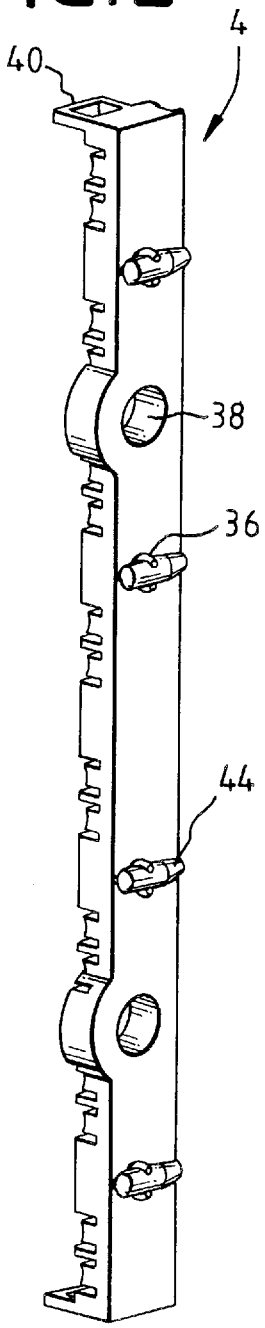
FIG. 2 is a perspective view showing the front side of a cable strain relief element of the high density, high performance connector according to the invention.

Referring to the drawings in particular, the invention comprises a connector formed of connector halves, namely connector assemblies which are joined to form a connection. Preferably, the connector halves are identical and are each associated with a piece of furniture, such as a wall panel.

Figure 1:
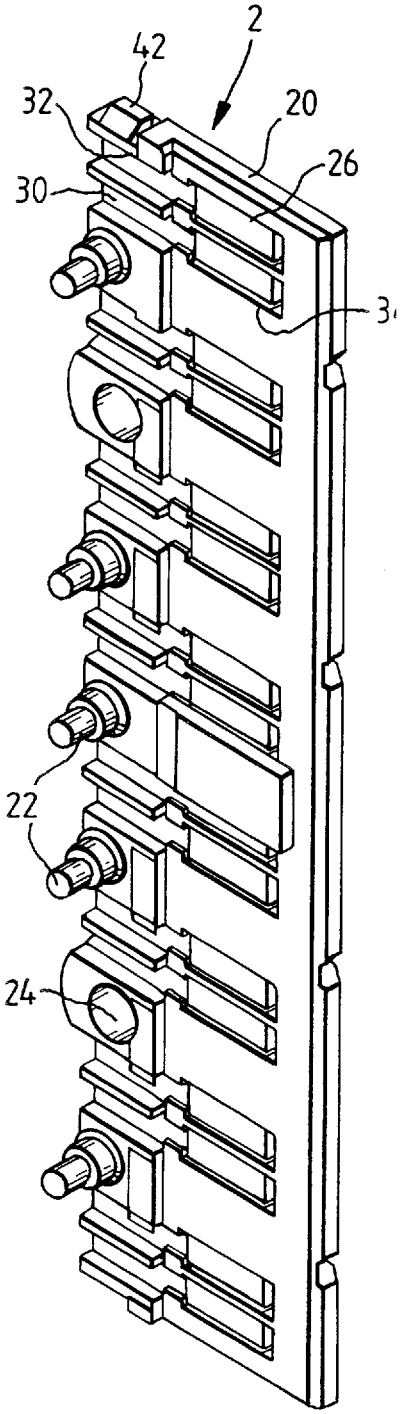
FIG. 1 is a perspective view showing the front of a base element of the high density high performance connector according to the invention.

Each connector assembly, includes a base element generally designated 2 as shown in FIG. 1 and a strain relief element generally designated 4 as shown in FIG. 2. The base element 2 is formed of a base portion 20 which may be of molded plastic. Posts 22 are provided for aligning the base element 2 with the stress relief element 4. Openings 24 are provided which may be used for connecting the assembly to the wall panel or similar furniture.

A plurality of grooves 26 are provided for receiving contacts 30. The preferred form of the base portion 20 includes 8 pairs of grooves 26 for receiving 8 pairs of individual contacts 30 for connection with 8 pairs of communication wires 12.

The base element 2 is provided with an incoming wire end 32 and with a contact area 34. Each of the contacts 30 extend into the contact area 34. The contacts 30 include wire connection means 70 (FIG. 13) at the wire connection end 32 for providing an electrical connection between a communication wire 12 and an associated contact 30. The wire connection means 70 is preferably an insulation displacement contact but can be another connection structure (such as a weld).

Figure 26:
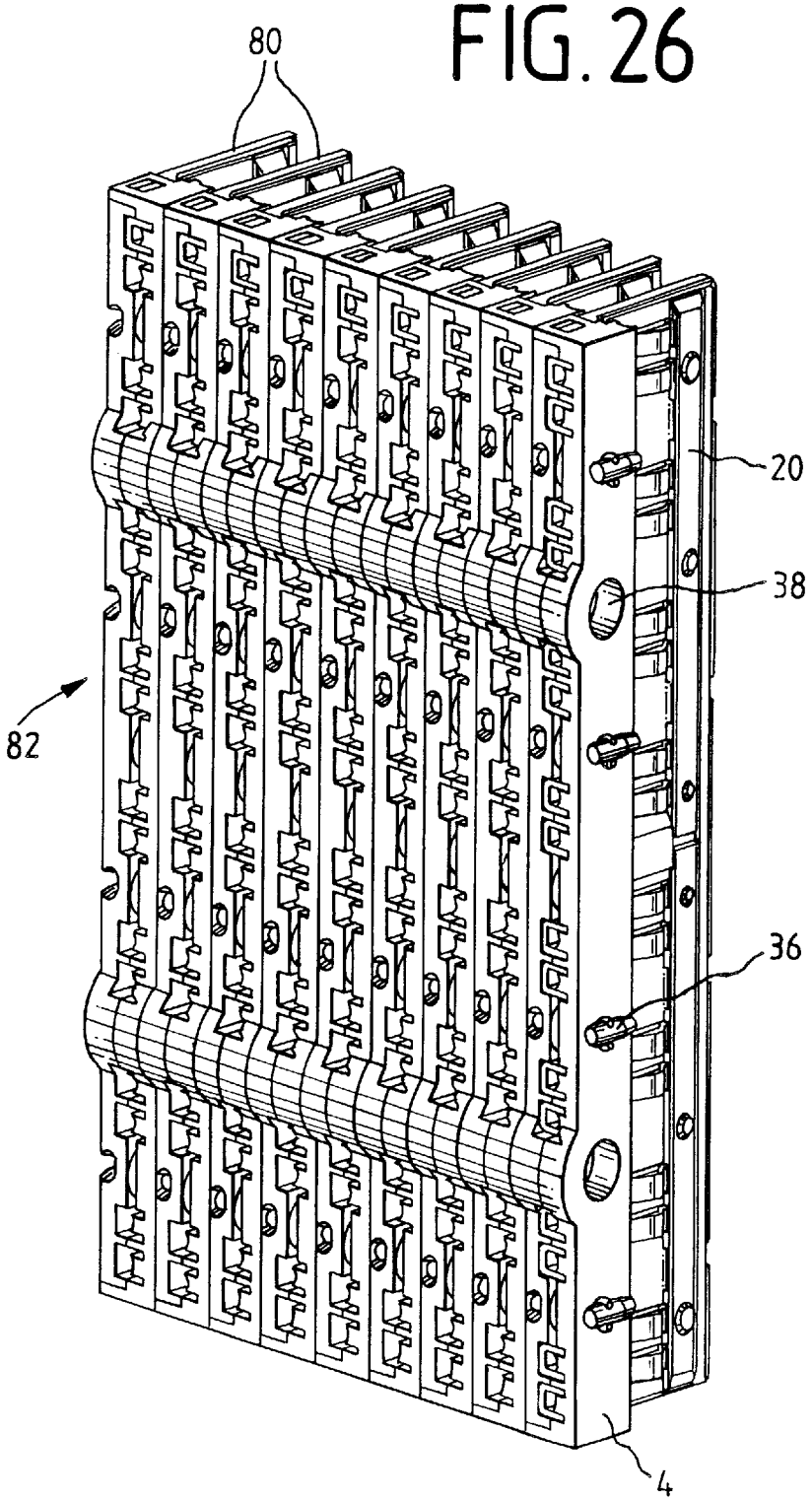
FIG. 26 is a perspective view showing a stack of assemblies.

When communication wires such as communication wires 12 are connected to the base element 2, the strain relief guide element 4 is disposed on top of the wires. This provides support (strain relief) to the wires. The base element connected (see FIG. 22) to strain relief guide 4 forms an assembly 80 (FIG. 26). The assembly then is mated or connected with a similar (preferably identical) assembly to form a connection. Several assemblies on each connection side may be joined or stacked to form stacked assemblies 82 (see FIG. 26). A tap 16 may be positioned between the mated assemblies.

The strain relief element 4 includes a plurality of engaging posts 36. These engaging posts 36, allow for the stacking of a plurality of assemblies 80. The strain relief element 4 also includes openings 38 which are aligned with openings 24, when the strain relief element 4 is connected with the base element 2. As can be seen in FIG. 2, the strain relief element includes latching means with a latch opening 40 for receiving a latch element 42 of the base element 2.

Figure 3:
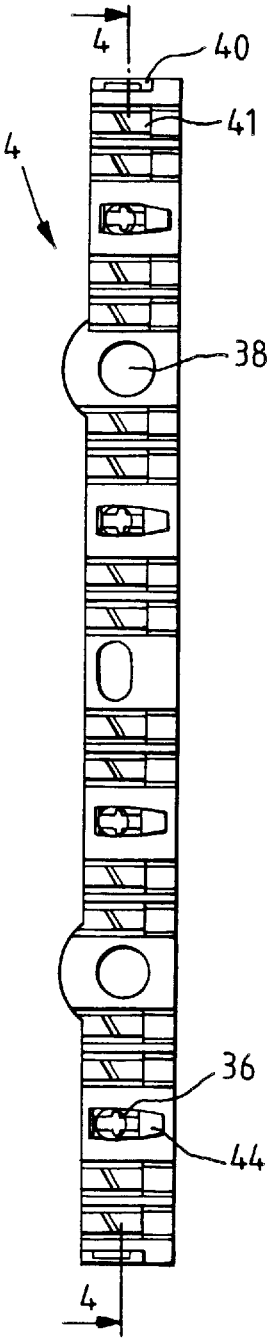
FIG. 3 is a front view of the strain relief element of the connector according to the invention.
Figure 5:
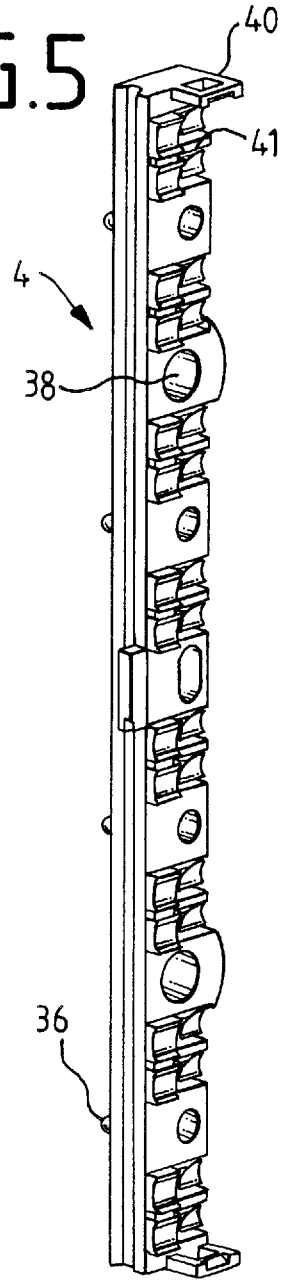
FIG. 5 is a perspective view showing a rear side of the strain relief element of the connector according to the invention.

As can be seen in FIG. 3 and 5, the strain relief element 4 includes a plurality of wire engaging and pressing elements 42. These elements 42 press down on the wire and help immobilize the wires. The pressing elements 42 forms part of the wire engaging and pressing means of the assembly.

Figure 4:
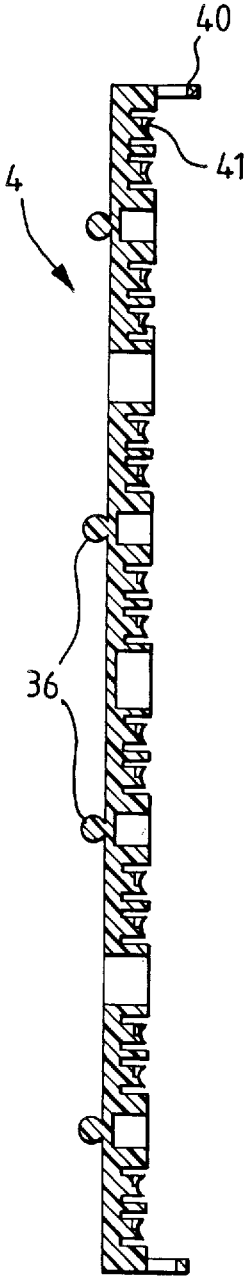
FIG. 4 is a cross-sectional view of the strain relief element taken along line 4—4 of FIG. 3.

As can best be seen in FIG. 4, the engaging posts or connection elements 36 are preferably substantially cylindrical. These male type connection elements 36 include a tapered or conical tip 44, allowing the elements 36 to slide into respective slotted receiving openings 46 (see FIG. 6).

Figure 6:
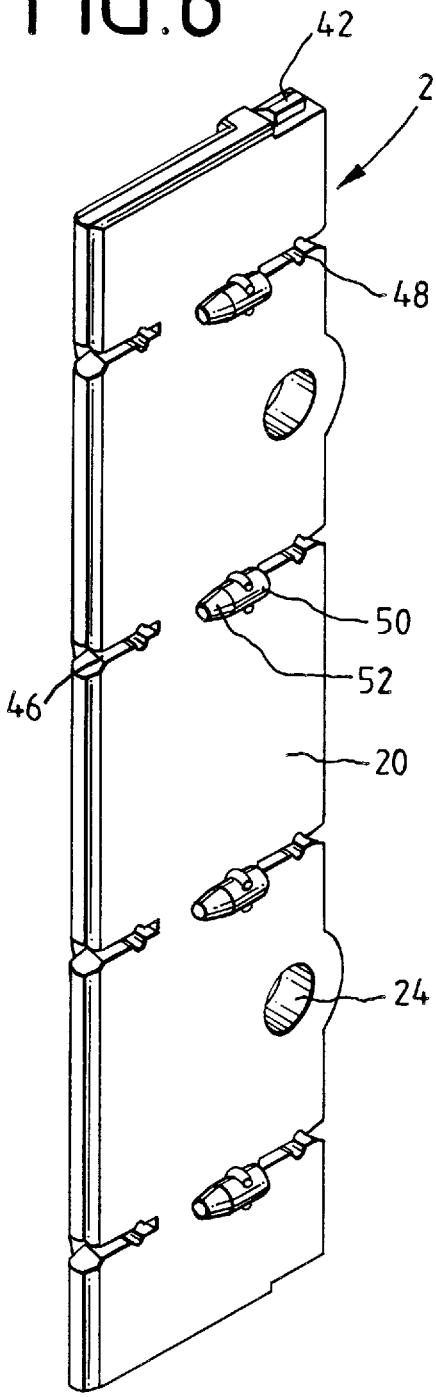
FIG. 6 is a perspective view showing the rear side of the base element of the connector according to the invention.

FIG. 6 shows the back side or rear side of the base element 2. The base portion 20 is preferably a single molded plastic piece. The strain relief element 4 is also preferably a single molded plastic piece.

The base portion 20 is formed with the slotted openings 46 as well as slotted openings 48. The slotted openings 46 receive the connection elements 36 of the strain relief guide from another assembly 80 whereby several assemblies can be stacked to form the stacked assemblies 82. The slotted openings 48 on the other hand receive engagement elements 50 of another assembly 80. The engaging elements 50 are provided including a conical tip 52 and a connection web portion, connecting the engagement element 50 to the remainder of the base portion 20 (see for example FIG. 10). A slot 56 of the slotted opening 48 (slotted opening 46 is the same) allows the connection element 50 to be connected to its associated base portion 20 via webs. The webs pass through the slot as the connection element 38/50 slides into the opening 46/48. The engagement of the connection elements 38/50 and the receiving openings 46/48 can best be appreciated from FIG. 17.

Figure 7:
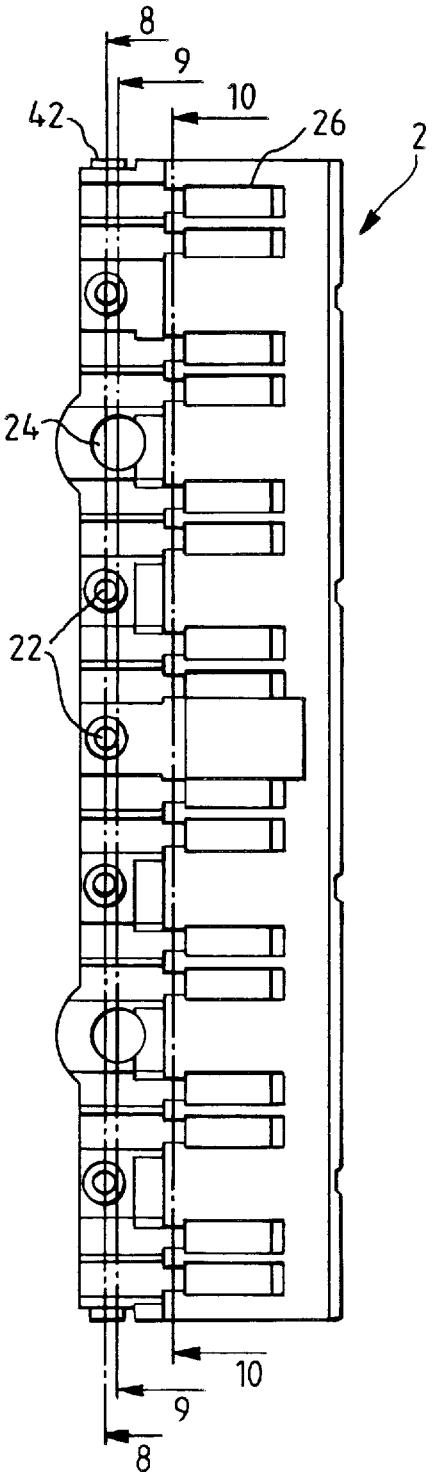
FIG. 7 is a front view of the base element of the connector according to the invention.
Figure 8:
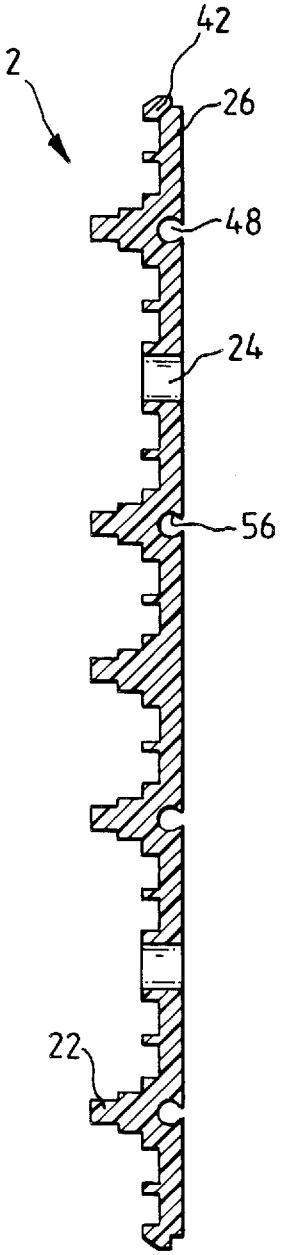
FIG. 8 is a cross-sectional view of the base element of the connector, taken along line 8—8 of FIG. 7.
Figure 9:
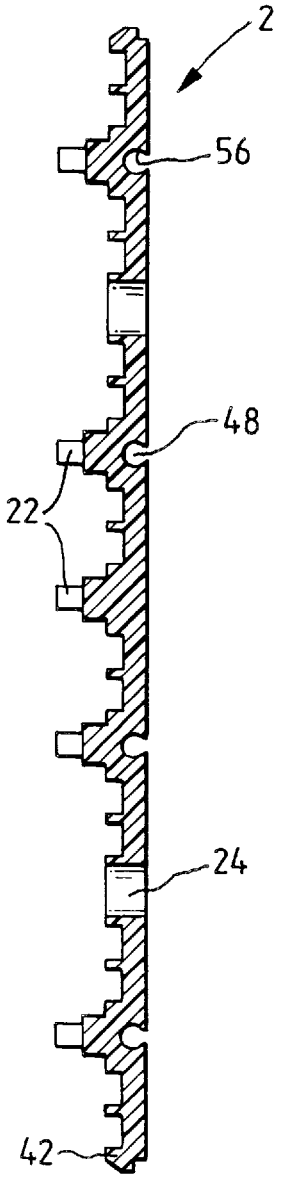
FIG. 9 is a cross-sectional view of the base element of the connector, taken along line 9—9 of FIG. 7.
Figure 10:
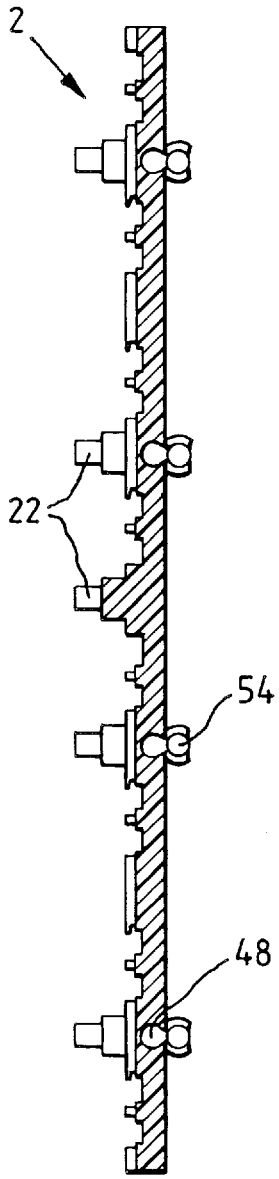
FIG. 10 is a cross-sectional view of the base element of the connector, taken along line 10—10 of FIG. 7.

FIG. 7 shows the base element 20 without the conductors 30. FIGS. 8, 9 and 10 show different cross-sectional views of the base portion 20, from the various cross-sectional lines 8—8, 9—9 and 10—10 of FIG. 7. Each of the cross-sectional views of FIGS. 8, 9 and 10 show the slotted openings 48. FIGS. 8 and 9 show the slot 56.

Figure 11:
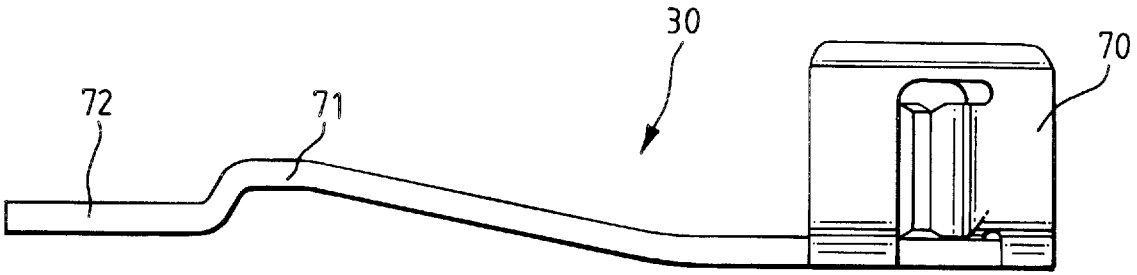
FIG. 11 is a side view of a contact of the connector according to the invention.
Figure 12:
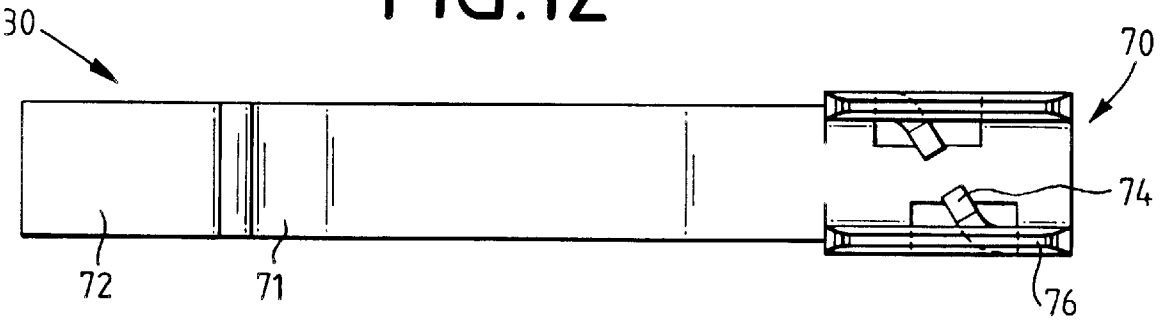
FIG. 12 is a top view of the contact.
Figure 13:
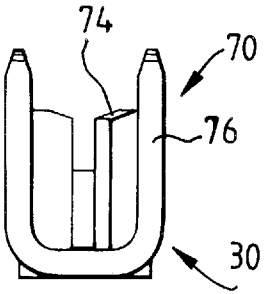
FIG. 13 is a front end view of the contact.

FIG. 11 shows a side view of a preferred contact 30 according to the invention. The contact preferably includes a termination end 70 which is positioned adjacent to the wire end 32 of the base element 2. The contact 30 also includes a contact face 68 which is disposed at the contact area 34 of the base element 2. As can be seen in FIG. 13, each termination end 70 includes opposed cutting/clamping elements 74. The cutting/clamping elements 74 are preferably supported by a U-shaped support 76. The U-shape support 76 provides some resiliency to the cutting/clamping element 74 and provides the necessary pressure for maintaining contact between the core of the wire and the cutting/clamping element 74. This structure allows a wire to be pressed between the cutting/clamping element 74 with the U-shaped structure providing resiliency. The cutting/ clamping elements 74 cut into the insulation of the wire and make contact with the core of the wire to provide electrical connection from the wire to the contact 30.

Figure 14:
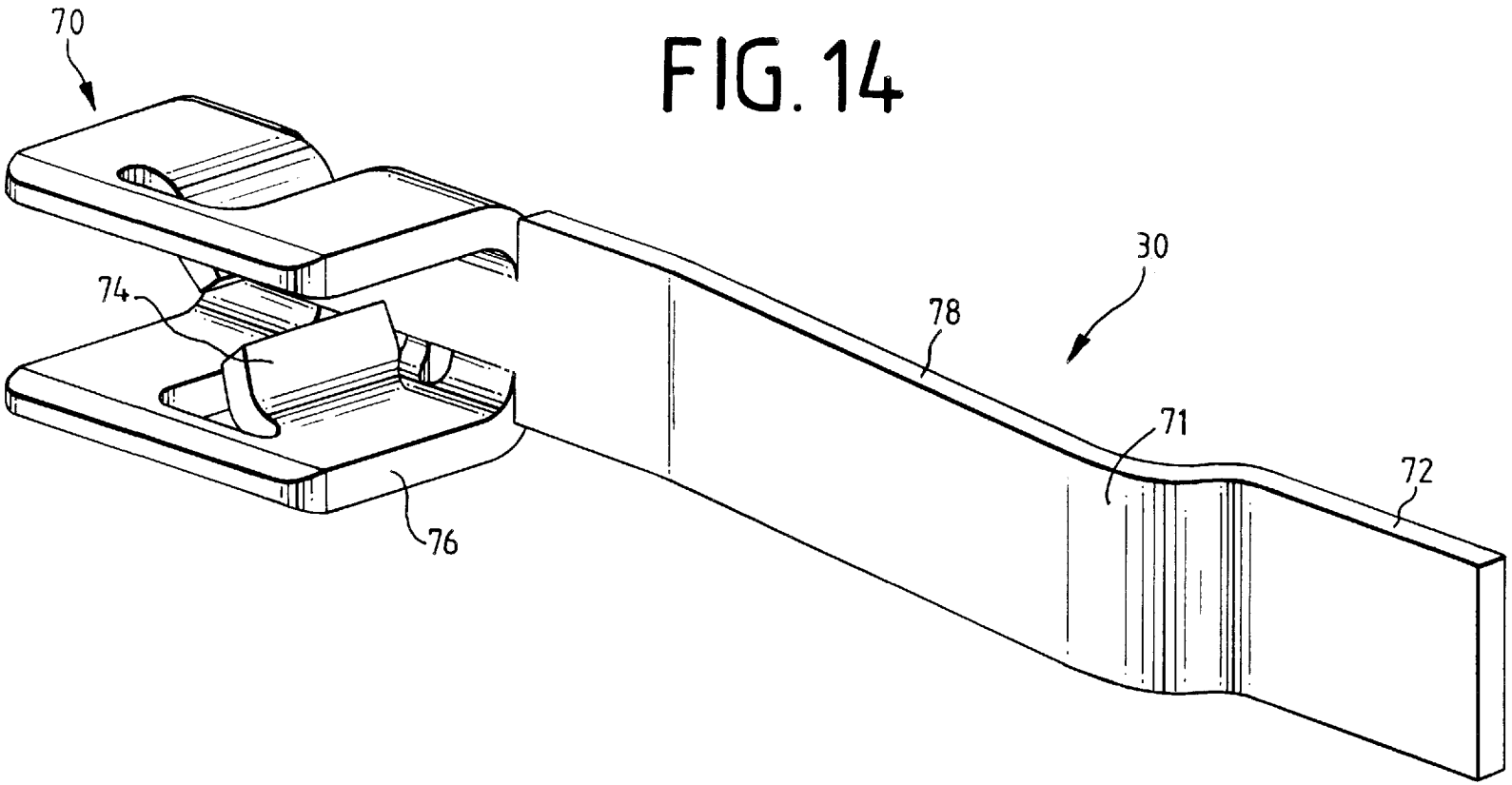
FIG. 14 is a perspective view of the contact.

The contact 30 has a contact arm 78 which includes the contact face 68 (see FIG. 14). The contact arm 78 is preferably resilient allowing the contact face 68 to be moved relative to the base element 2, namely pressed toward of the base portion 20 (in a non-contact position). This movement preferably results in the contact face 68 moving into or toward the groove 26. The contact face 68 extends out of the groove 26 (in a contact position).

FIG. 14 shows a view of the termination end 70 clearly showing the cutting edge of one of the two cutting/clamping element 74. The cutting/clamping element 74 may be formed of the same piece of metal as the U-shaped part 76 and may be punched out to dispose the element 74 at an angle with respect to a wire disposed within the U-shaped part 76.

The invention provides a mechanism for moving the contact face 68 of each contact between the contact position and the non-contact position. This is accomplished by providing one or more contact opening device (COD) which presses the contact 30 into the non-contact position or allows the contact 30 to be maintained in the contact position.

Figure 15A:
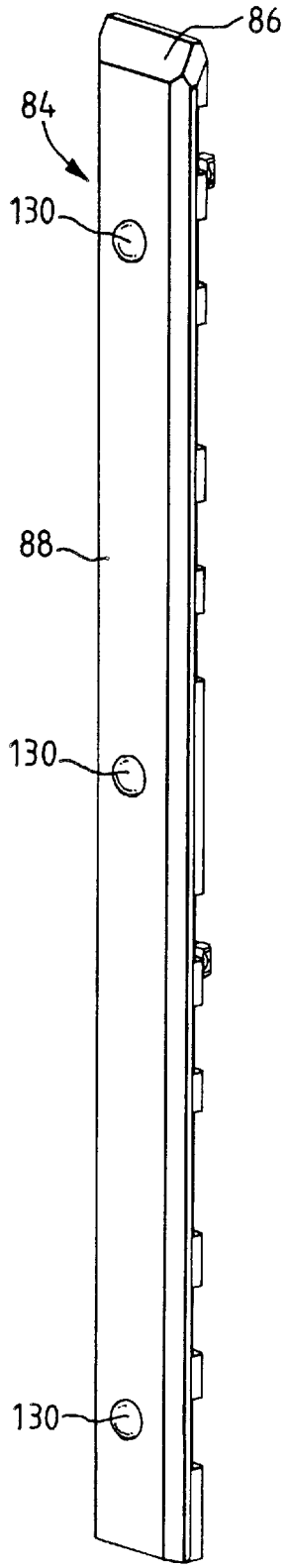
FIG. 15*a* is a perspective view showing an actuation side of an upper contact opening device of the invention.
Figure 15B:
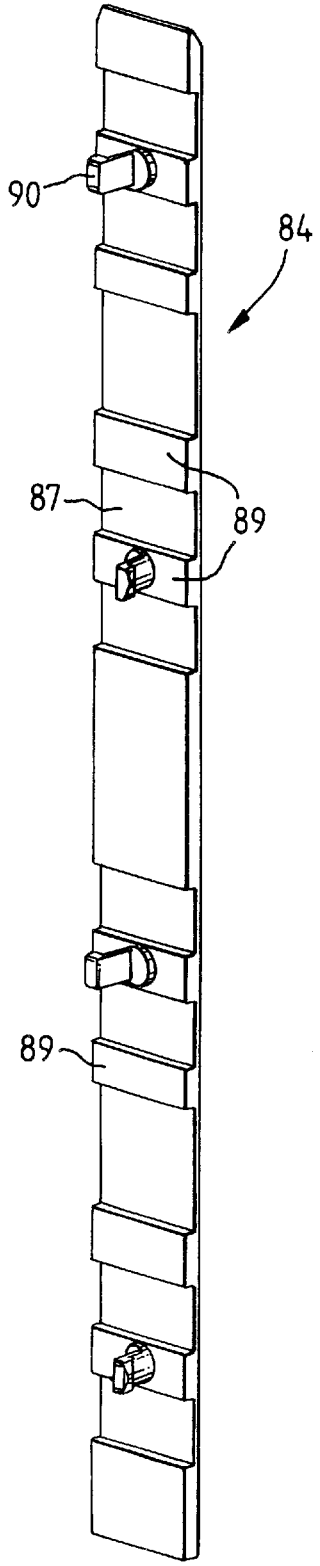
FIG. 15*b* is a perspective view showing the contact side of the upper COD of FIG. 15*a;*
Figure 16A:
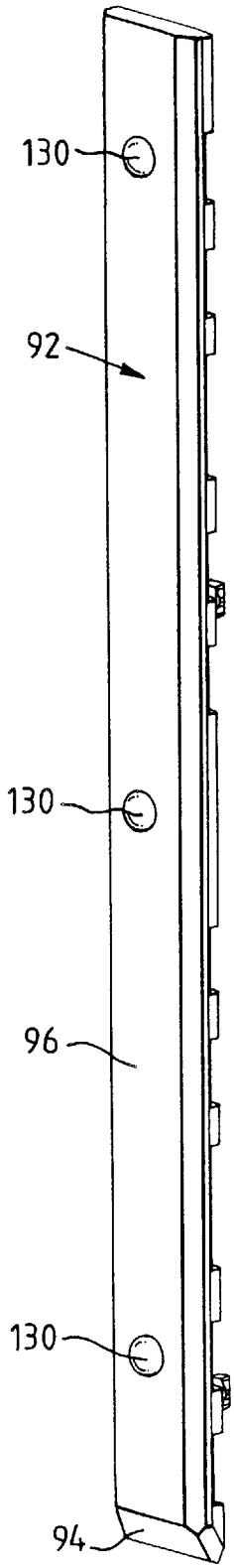
FIG. 16*a* is a perspective view showing an actuation side of an upper COD.
Figure 16B:
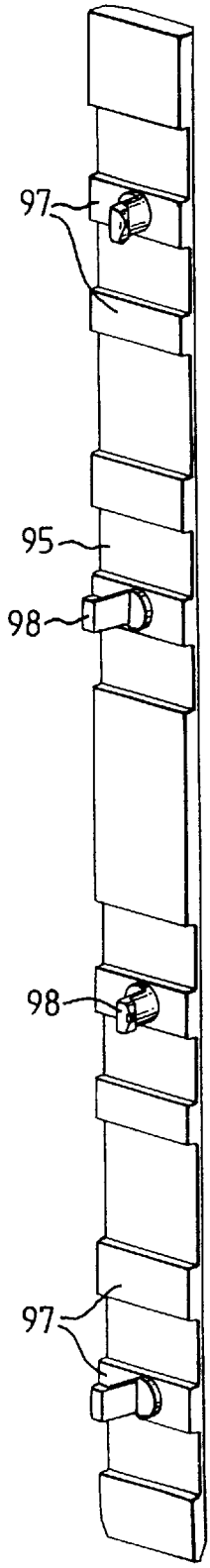
FIG. 16*b* is a perspective view showing the contact side of the COD of FIG. 16*a;*

FIG. 15*a* shows an actuation side of an upper COD 84. The COD 84 includes a bevelled upper edge 86 and an actuation side 88. FIG. 16*b* shows the upper COD 84 including a plurality of connectors 90. The connectors 90 connect the upper COD 84 to an upper part of the base element 2 with an actuation end 72 of the contact 30 being disposed between the COD 84 and the base element 2. As can be seen in FIG. 16*b*, the contact side 87 of the upper COD 84 includes a plurality of contact surfaces 89 which act to press the contact 30 into the non-contact position.

As can be seen in FIG. 15*a*, the upper COD 84 includes a plurality of connector posts 90. The connector posts 90 may be provided such that they pass through a contact 30 and then are fixed to the base portion 20. However, according to a preferred design of the invention, each of the contacts 30 is seated in a corresponding groove 26. The connector posts 90 are located adjacent to the contacts 30 and preferably extend past the contacts 30 in a region between groups of contacts (see FIG. 17). Specifically, each post 90 passes into an opening 120 provided in the base element 20. The post 90 may be provided with a latch element which prevents the COD 84 from being disconnected from the base portion 20. The distance between the latch element and the contact surface 89 of the COD 84 is set to provide the ability of the COD 84 to move relative to the base portion 20, as further described below.

The preferred design of the electrical connector according to the invention further includes a lower COD 92 which includes a beveled lower edge 94. FIG. 16*a* shows the actuation side 96. FIG. 16*b* shows the contact side 95. As can be seen in FIG. 16*b*, a plurality of connector posts 98 are provided for connecting the lower COD to a lower part of the base element 2. The contact side 95 includes a plurality of contact surface portions 97. These correspond with the number of contact elements 30. These surface portions 97 are provided for moving the a lower set of contacts 30 from the contact position to the non-contact position, by pressing on an actuation end 72 of the contact 30. The connector posts 98 each connect to a corresponding connector post opening 120 in the base portion 20, as described above with regard to posts 90. Again, the end of the connector post 98 maintains the COD 92 in connection with the base portion 20 but allows some movement (toward and away from the base portion 20) as further discussed below.

Each of the upper COD 84 and the lower COD 92 include a plurality of nubs 130. These nubs are in the form of protruding portions. Nubs 130 protrude from the surface of the actuation side 88 of the upper COD 84 and likewise the nubs 130 protrude from the surface of the actuation side 96 of the COD 92.

Figure 22:
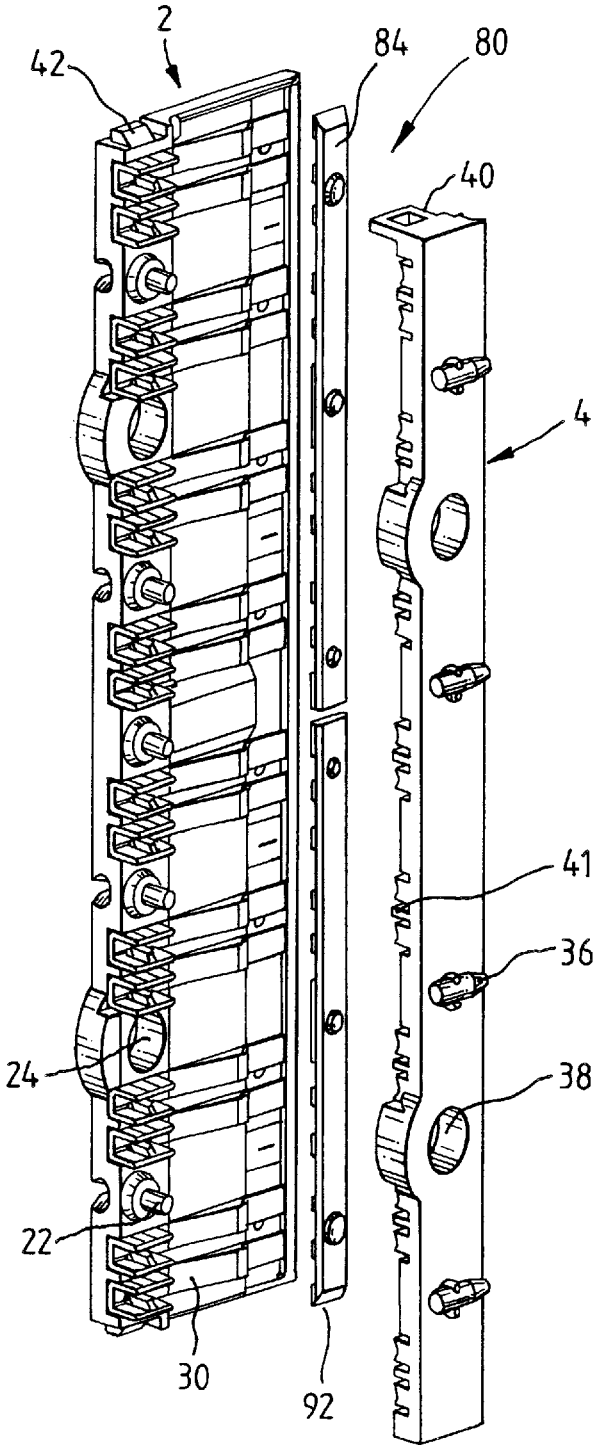
FIG. 22 is an exploded view showing the base element of FIG. 20 with a strain relief element, illustrating the connection of the strain relief element to the base element, the strain relief element being partially cutaway.
Figure 23:
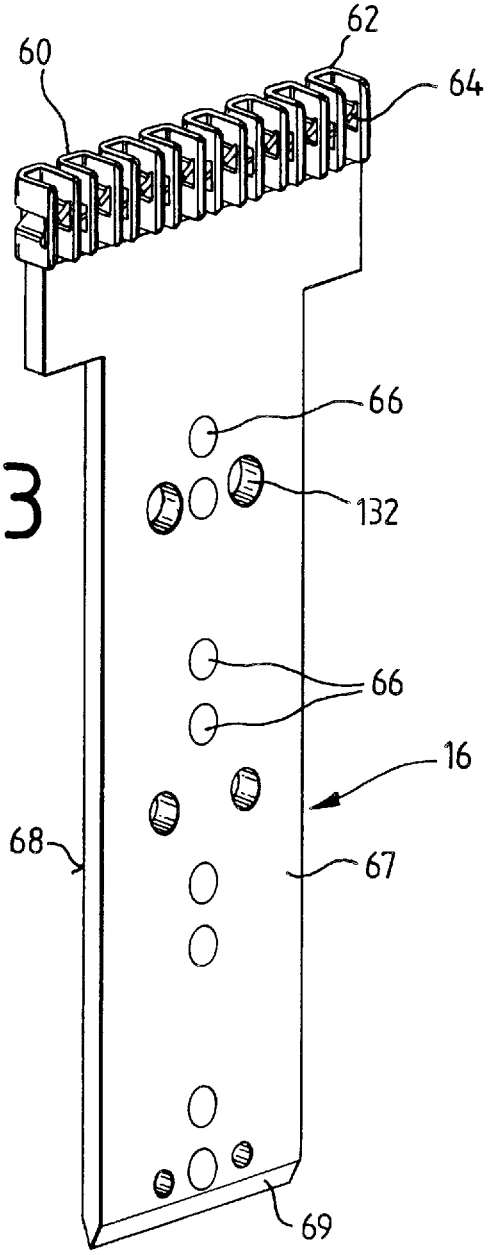
FIG. 23 is a perspective view showing a tap according to the invention.

FIG. 22 shows a base element 2 including the base portion 20 and the contacts 30. The contacts 30 are positioned or located by the grooves 26 formed in the base portion 20.

Figure 17:
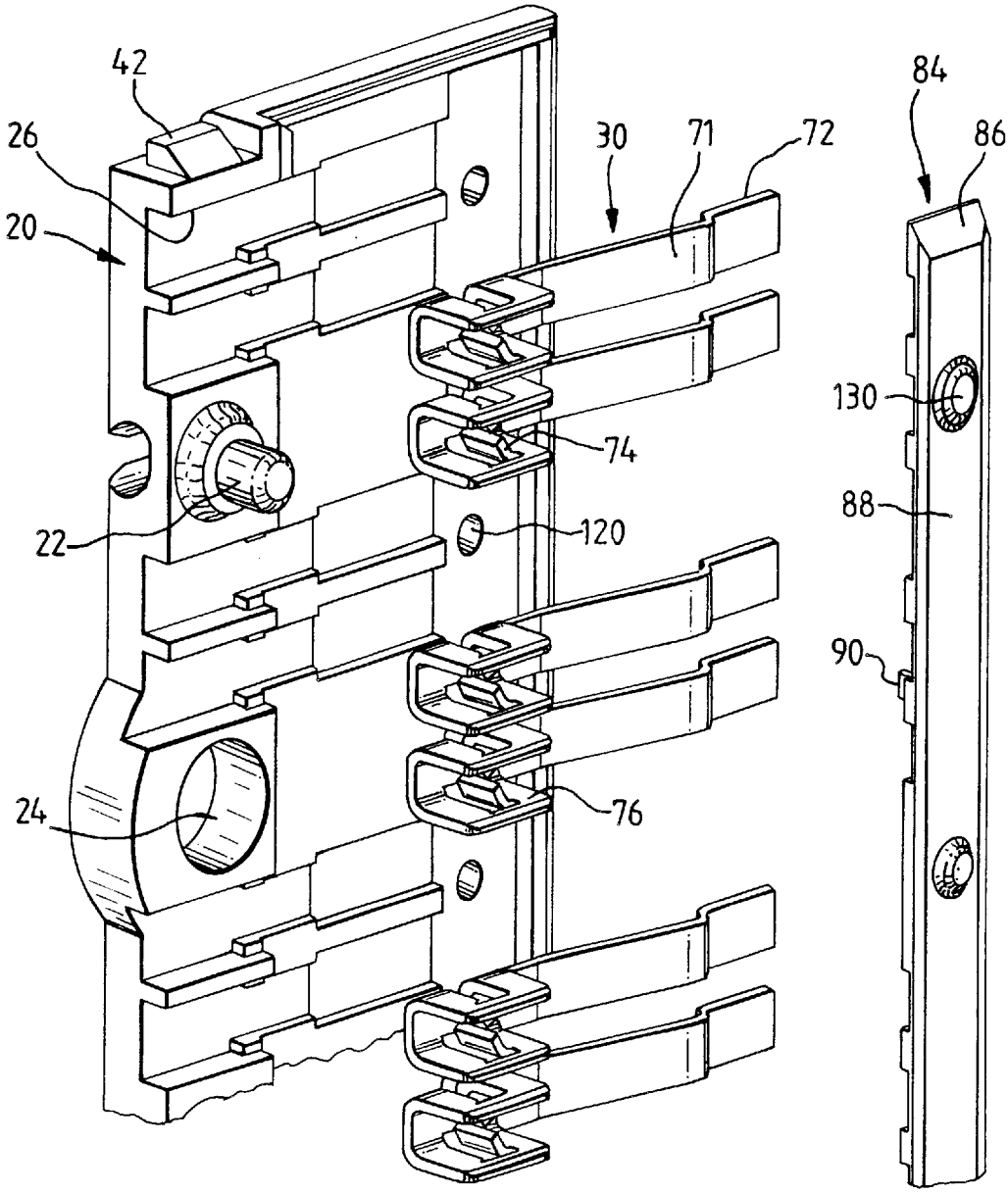
FIG. 17 is a exploded view showing the disposition of the contacts and upper COD with respect to the front of the base element.

FIG. 17 is an exploded view showing the contacts 30, the upper COD 84 and a base portion 20. The grooves 26 for positioning or locating the contacts 30 are provided for receiving the contacts 30. The posts 90 of the upper COD 84 are snapped into the openings 120 and are retained by the end of the post 90. However, the length of the post 90 is designed with respect to the width of the base portion 20 to allow COD 84 to move away from and toward the base 20. This degree of movement allows the COD to press the actuation end 72 of the contact 30 such that the contact 30 is moved to a non-contact position (the contact face 68 is moved toward the base portion 20 such that it is not in physical contact with an opposing contact surface 68 of an opposite connector). The resilient nature of the contacts 30 normally press the COD away from the base portion 20.

Figure 18:
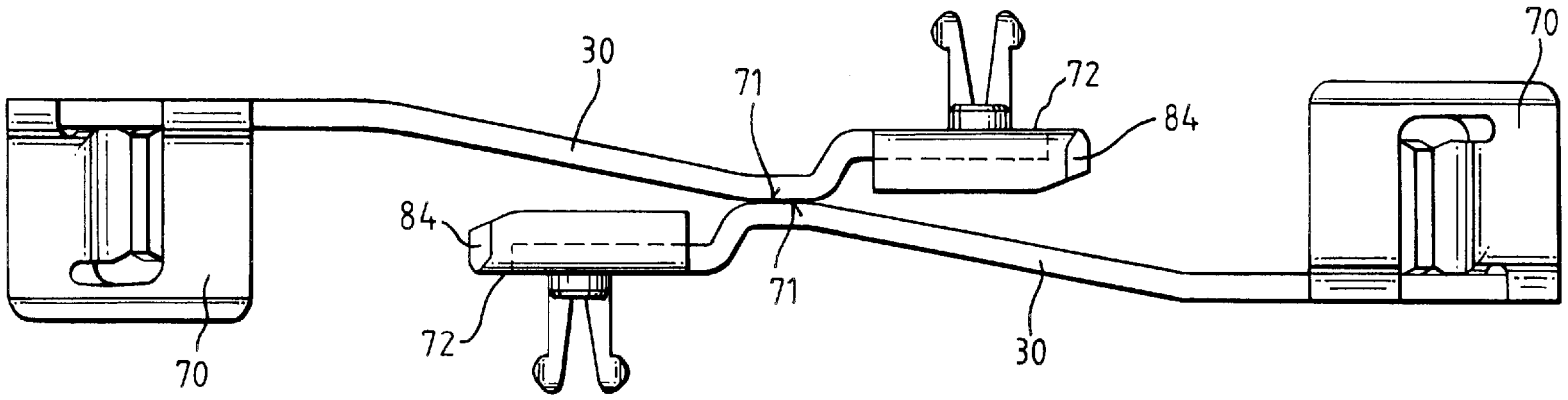
FIG. 18 is a top view showing a contact connected to a COD of one connector and a contact engaging a COD of another connector wherein the two contacts are touching, in a contact position.

FIG. 18 shows the position of the COD elements 84 and the contacts 30 for two different connector assemblies (namely mating connector assemblies). The contacts 30 are shown in the contact position (the contact face 68 of each contact 30 is in physical contact with a contact face 68 of an opposing contact 30). As can be appreciated from this view, movement of one or both of the COD's 84, in a direction toward their associated base portion 20 of their respective assemblies, results in the contact 30 being moved out of the contact position.

Figure 19:
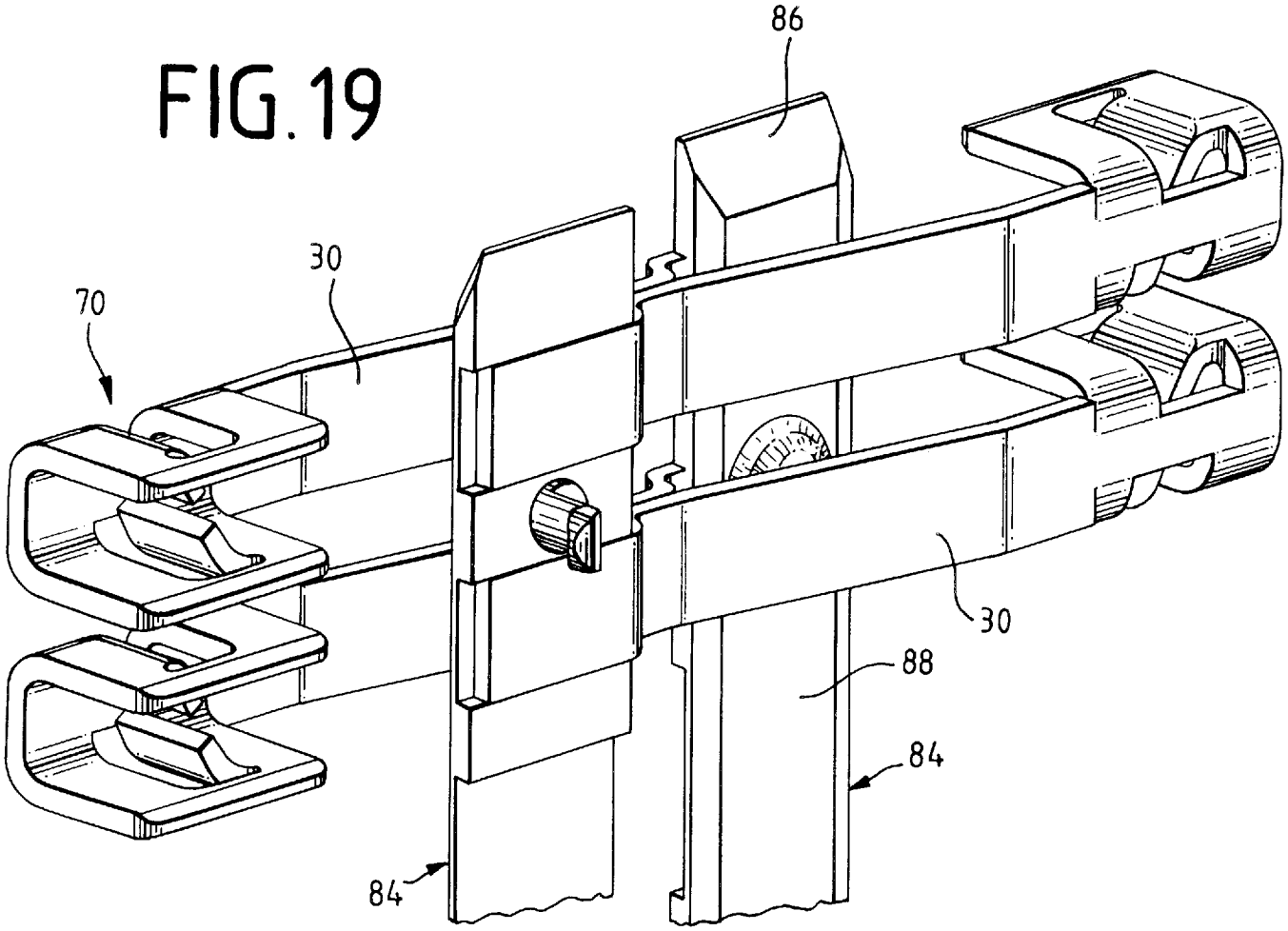
FIG. 19 is a perspective view showing an upper COD and two contacts of one connector and an upper COD and two contacts of another connector to illustrate the orientation of the two connectors and to illustrate the contact position.

FIG. 18 provides a prospective view showing the relationship between mating contacts 30 and the respective upper COD's 84. FIG. 19 also shows the bevelled upper edge 86 which facilitates the passage of a tap into the space between the contacts 30 (as described further below).

Figure 20:
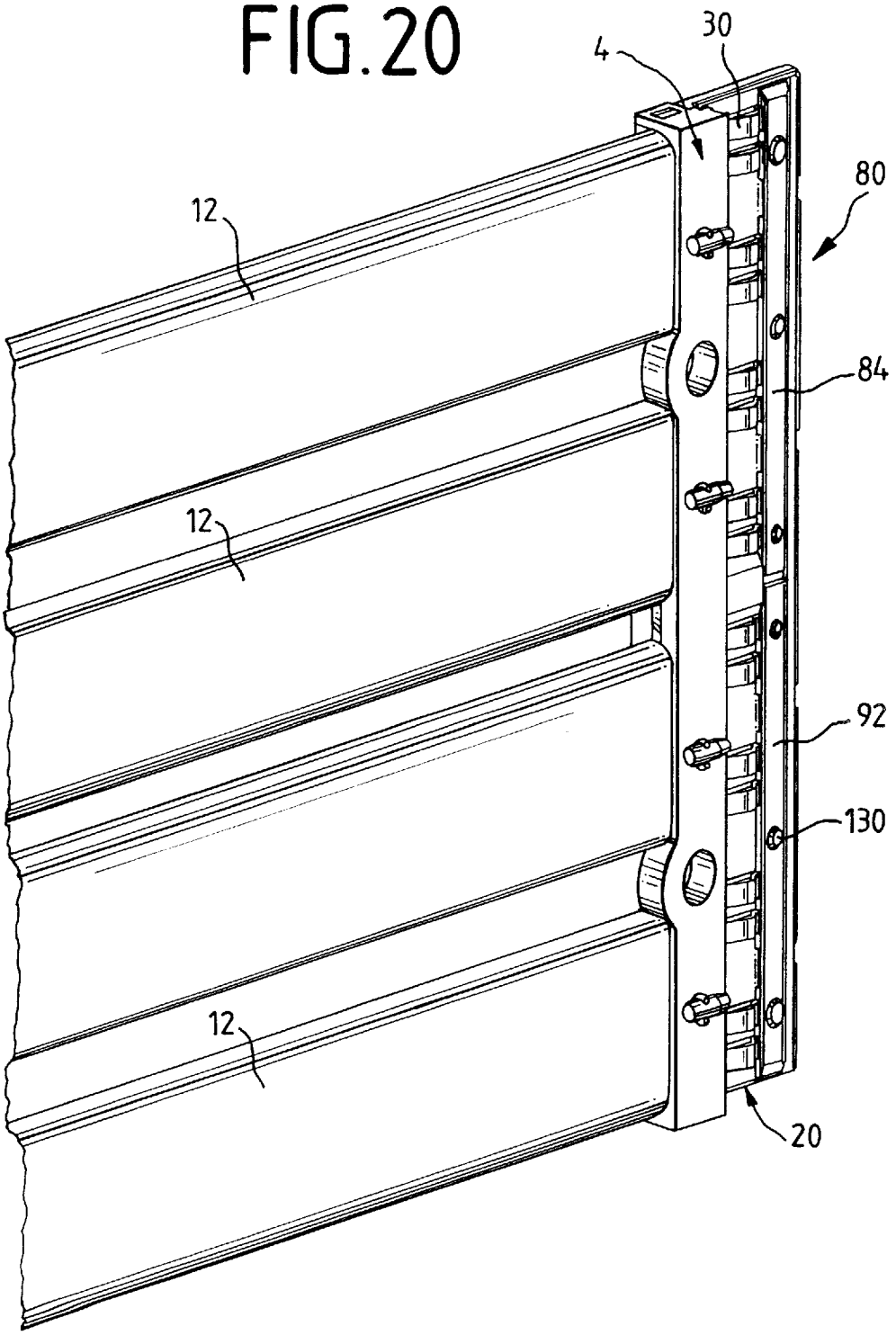
FIG. 20 is a perspective view showing the base element with contacts and upper and lower COD.

FIG. 20 shows an assembly 80 the base element 2 including the base portion 20, the contacts 30, upper COD 84 and lower COD 92. The upper COD 84 and the lower COD 92 are fixed to the base portion 20 via the connector post 90 and 98 respectively. The strain relief element 4 is engaged with the base portion 20 with the wires 12 (within wire bundles) connected (terminated) at contacts 30.

Figure 21:
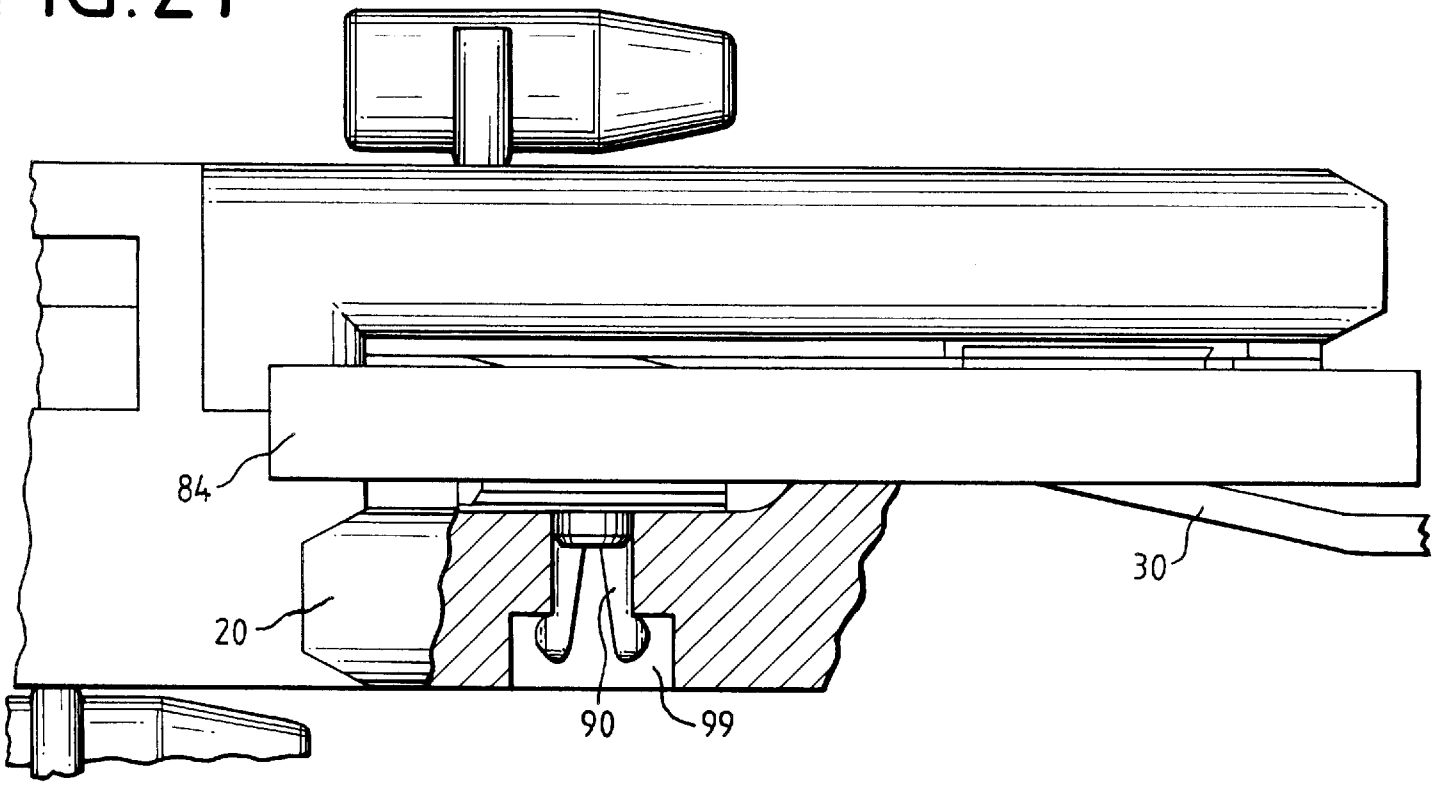
FIG. 21 is a side view showing the connection of the COD to the base element.

The connection of the COD 84 to the base portion 20 can best be seen in FIG. 21. The base portion 20 is formed with receiving sockets 99, each receiving socket for receiving expanding parts of the connector post 90.

A preferred form of the assembly 80 is shown in FIG. 22 in an exploded view. The lower part of the strain element 4 is cutaway. Nevertheless, with this exploded view, it can be appreciated that the strain element according to the preferred design snaps on with the latch element 42 going into the latch opening 40. With a wire 12 connected to each of the contacts 30, the base element is connected to the strain relief element 4 by pressing the latches 41 into associated latch receiving openings 40. This provides an assembly 80.

According to a preferred form of the invention, the base element 2 is connectable to eight pairs of wires 12. The contacts 30 are arranged in pairs of two in pairs of grooves 26. The termination end 70 of each contact 30 is engaged with a wire. The lower half of the base element 2 also includes eight contacts, namely four contact pairs. With this arrangement, eight pairs of wires may be connected to the base element 2 which then forms an assembly with the strain element 4.

A tap generally designated 16 is provided to connect the communication wires 12 to the end user at the workstation via the base element 2. The tap 16 includes a user interface part 60. The user interface part 60 includes a plurality of insulation displacement contacts (IDC) 62. This may be in the form of a cutting/clamping arrangement including a cutting/clamping metal element 64 which cooperates with a strain relief portion (not shown). Wires to the user at the workstation may be terminated at the termination block or user interface part 60 wherein each wire connected to an IDC 62 is to be connected through to a corresponding communication wire 12, connected to the base element 2.

The tap 16 includes a plurality of contacts 66 on a contact tap side 67 of the tap 16. The connection between the contacts 62 and the contacts 66 may be by a printed circuit (traces etc.) extending on or in the contact tap side 67. Similarly, the tap has an insulation side, a side 68 which is free of contacts. Accordingly, the tap 16 taps a signal from a series of contacts 30 of one assembly 80 of two mated assemblies. The tap 16 interrupts the signal from proceeding to the other assembly because of the insulation side 68. The tap 16 includes a bevelled edge 69 which facilitates inserting the tap into the space between two mated connector assemblies 80. The preferred form of the tap 16 provides 8 contacts 66 which engage 8 contacts 30 of the 16 contacts 30 of an assembly 80, either an upper set of contacts 30 or a lower set, depending on whether the tap 16 is inserted from the top or the bottom (from the top the tap 16 engages the upper COD 84 and from the bottom the tap 16 engages the lower COD 92).

Figure 24:
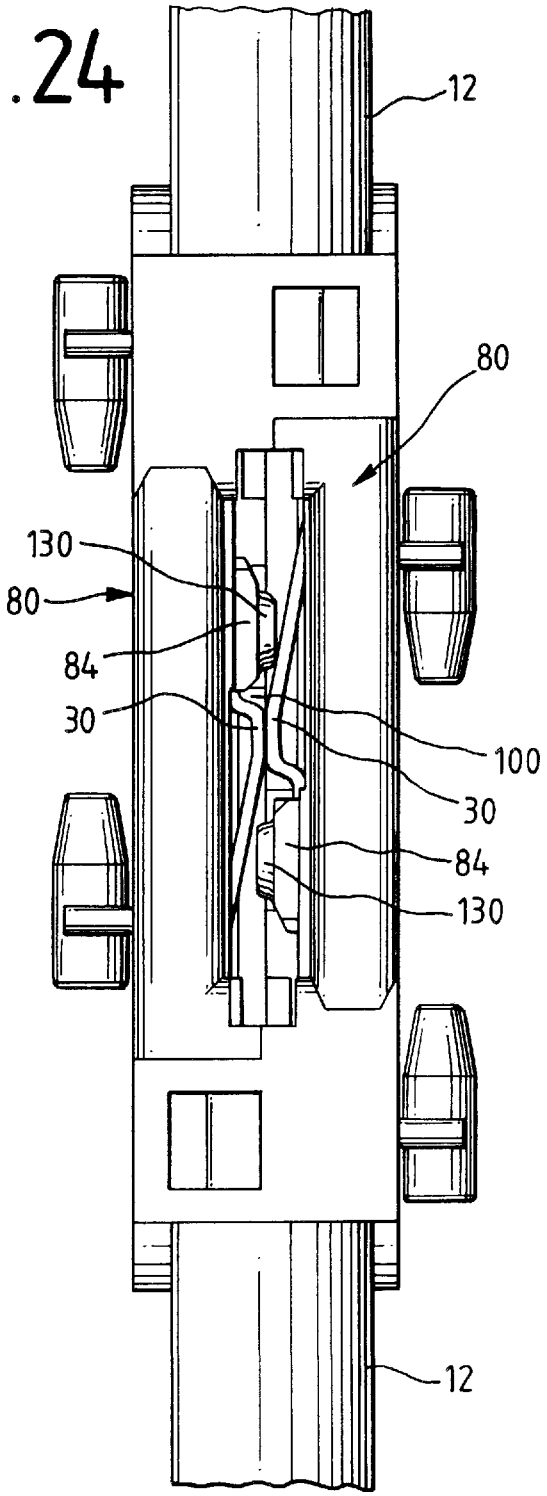
FIG. 24 is a top view showing the location wherein the tap is inserted for tapping the various contacts 30.

FIG. 24 provides a view showing the space into which the tap is inserted. The opening at the top, formed by two mated assemblies 80, provides access to the upper COD 84 of a first assembly 80 and the upper COD 84 of a second assembly 80. A similar (substantially identical) arrangement is provided with respect to the bottom of the mated assemblies 80. The bevelled end 69 of the tap 16 is inserted into the tap insertion opening 100.

As noted above, each of the CODs include nubs 130. The tap 16 includes a plurality of nub receiving spaces, preferably in the form of holes 132. The holes 132 provide a space for receiving the nubs 130. When the tap is inserted into the opening 100 of the mated assemblies 80, the beveled edge 69 presses each COD toward its respective base portion 20. The tap surfaces 67 and 68 next come in contact with the nubs 130 which ensure a movement of the various contacts out of the contact position (to the non-contact position) wherein the contact surfaces 68 are spaced apart. Upon the tap being fully inserted into the unit, there is an alignment between nubs 130 and the corresponding holes or openings 132. This allows for movement of the COD toward the tap and allows the contacts 30 to move back toward the contact position. All of the contacts 30 associated with COD 84 facing the contact side 67 or the tap 16 engage one of the contact regions 66 of the tap 16 (the contact face 68 of each of these contacts 30 moves into physical and electrical contact with a corresponding contact 66 on the contact side 67 of the tap 16). The contacts 30 facing the insulation side 68 also move toward the contact direction. However, signals no longer pass through these contacts to the connected wires 12.

Figure 25:
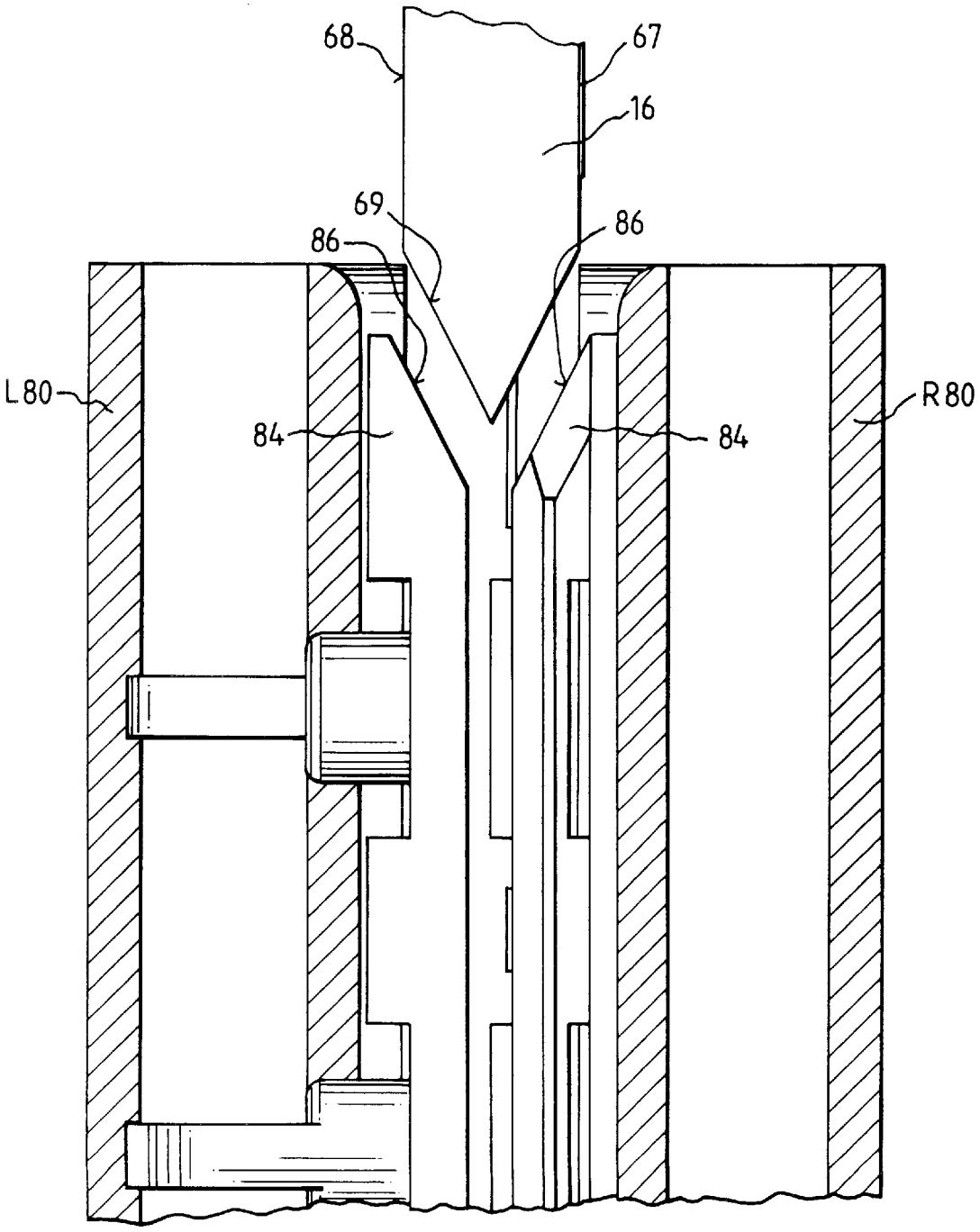
FIG. 25 is a cross-sectional view of two mated connectors with a tap about to be inserted at a location between contacts of one connector assembly and contacts of another connector assembly.

As can best be seen in FIG. 25, the bevelled end 69 of the tap 16 comes into contact with the upper bevelled surface 86 of each of the two upper COD's 84. As the tap 16 is pressed downwardly, the contacts 30 move from the contact position into the non-contact position. This disconnects the connection between for example a left side assembly L80 and a right side assembly R80. When the tap is fully inserted, only those contacts 30 which are on the contact side 66 of the tap 16 make an electrical connection with the contacts 66 of the tap 16. For example, with the tap 16 shown, the contact 67 is on the right side such that the contacts 30 of assembly R80 are in electrical contact with the various contacts 66 of the tap 16, when the tap 16 is fully inserted. The signal is thereby tapped and the contacts 30 of the assembly L80 are disconnected from the signal.

The insulation side of the tap can be seen in FIG. 25 wherein this insulation side is facing an assembly 80 which has been removed for illustration purposes. When the tap 16 in its inserted position the contacts 66 are engaged with the contacts 30 of the base part 20.

The assemblies may be stacked in groups. FIG. 26 shows a plurality of assemblies 80 stacked. The connection element 36 of each strain relief element 4 (except for the first strain relief element 4) is engaged with slotted openings 48 of the assembly directly in front of it. This provides a stack of assemblies 82.

In operation, a stack of assemblies 82 is mated with a substantially identical stack of assemblies 82. The assemblies 80 are formed of identical parts. Each strain relief element 4 is made with the same geometry and each base element 20 is made with the same geometry. This allows the use of just two molds for these parts. The assemblies 80 are also hermaphroditic. A third mold is used to make the third and fourth parts, namely the upper COD 84 and the lower COD 92. Of course any number of molds may be used and the important feature of the invention is the use of just four (molded) parts to form the assembly and stack of assemblies. Further, all of the contacts are of the same design.

FIG. 26 illustrates the position of assemblies in order to form the stacked assembly 82. The so called hermaphroditic nature of the connectors is apparent given that the engaging elements 50 form a male portion and the slotted openings 48 form a female portion. Each assembly has both male and female parts forming part of the connection means.

Figure 27:
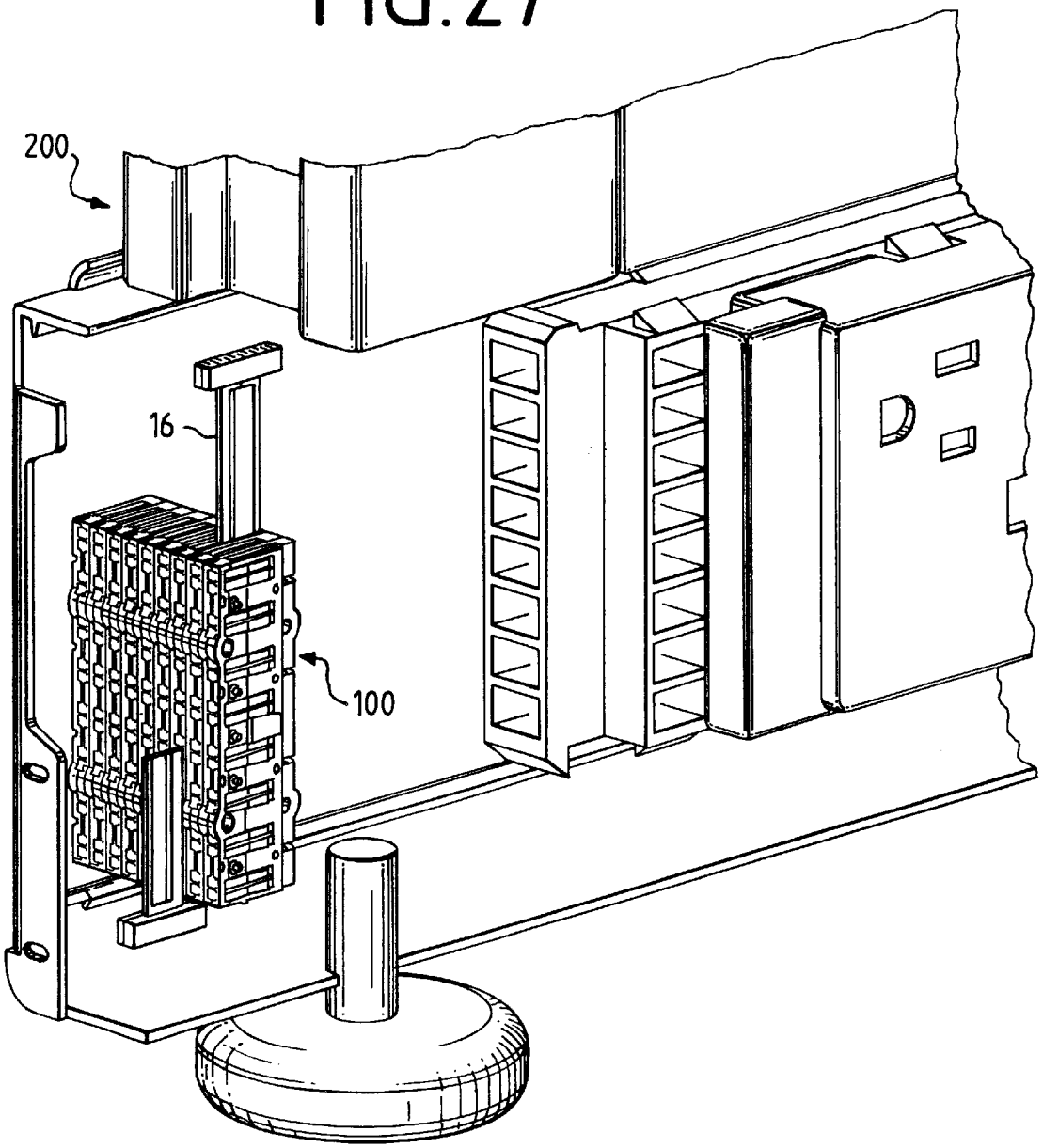
FIG. 27 is a perspective view showing assembly stacks in a mated position associated with furniture, with a tap in a position to be inserted with cables omitted for clarity.

The tap 16 may be provided at any location wherein a connection is to be provided to a user, at a workstation. For example, in assembling wall panels 200 as shown in FIG. 27, many of the wall panels 200 will be assembled wherein the data/voice lines are to be merely passed through, from the wires of one wall panel to the wires of another wall panel. However, at certain locations, a tap is required to provide the data or voice connection to the user, such as to a workstation.

When the tap is positioned between two engaged assemblies, the contacts 66 make electrical contact with corresponding contacts 30 of one assembly 82, providing a user with access to the data or voice lines. However, the lines are dead downstream of the tapped contacts of the mated assemblies as the non-contact side 94 of the tap does not make contact with contacts 30 of the opposite or engaged assembly 80.

Figure 28:
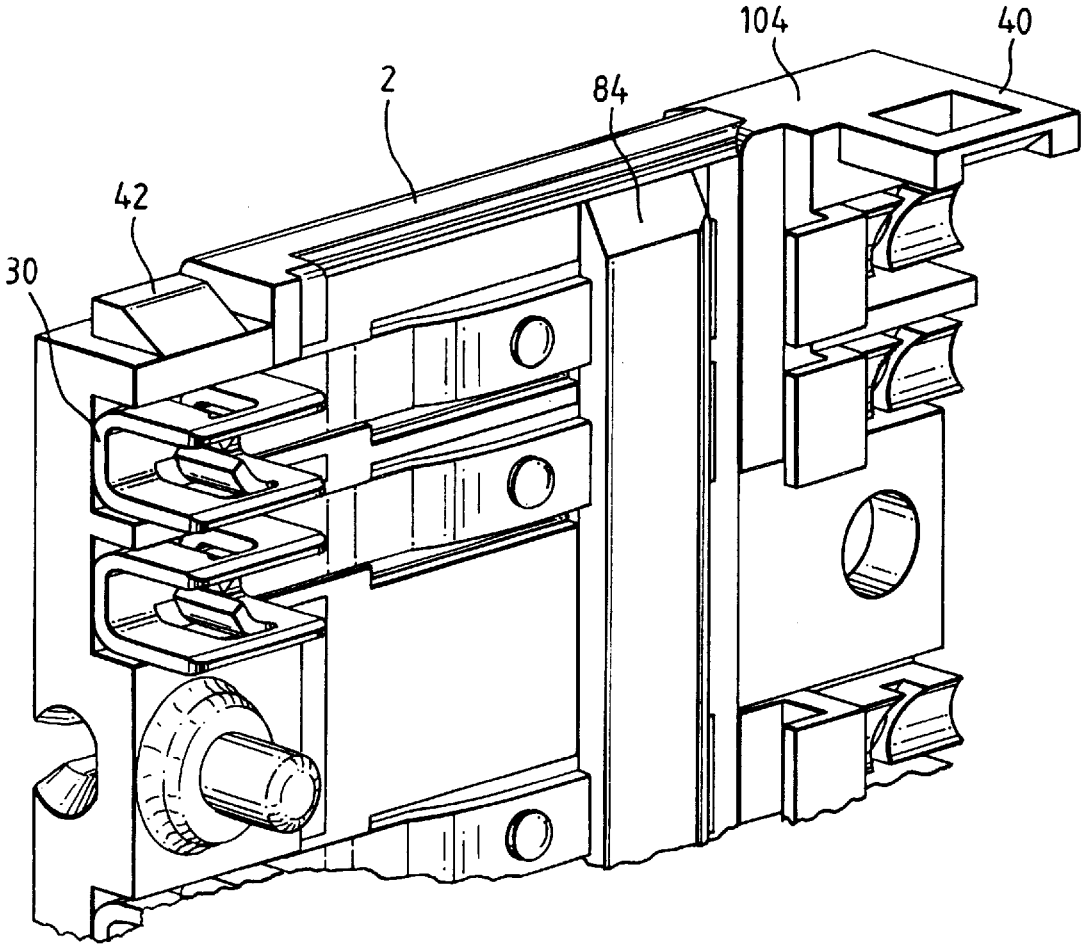
FIG. 28 is a perspective view of a portion of an assembly.

FIG. 28 shows a base element 2 with contacts 30 and COD's, namely an upper COD 84. Additionally, this element is provided with a strain relief element 104. The strain relief element 104 is connected to an end of the base element 2 as shown. With this arrangement, a single base element 2 with connected strain element 104 can be mated with another base element 2 with strain element 104. In this case the latch opening 40 of the strain element 104 connects to the latch element 42 of another base element 2 whereby one base element may be mated with another base element. This is useful for when a stack of assemblies is not required and 8 lines or less must be connected through. This arrangement still provides the same tap opening 100.

While specific embodiments of the invention have been shown and described in detail to illustrate the application of the principles of the invention, it will be understood that the invention may be embodied otherwise without departing from such principles.

What is claimed is:

1. A telecommunications and data connector, comprising:

a connector first side assembly with a first side base portion formed of plastic and including a wire connection end and an opposite end, a first side plurality of contact elements, each of said contact elements being positioned on said first side base portion and extending from adjacent to said wire connection end toward said opposite end, each of said first side contact elements being movable between a contact position and a non-contact position, each of said first side contact elements including a contact area and a wire connection means for making an electrical connection with a wire;

a connector second side assembly with a second side base portion formed of plastic and including a wire connection end and an opposite end, a second side plurality of contact elements, each of said contact elements being positioned on said second side base portion and extending from adjacent to said wire connection end toward said opposite end, each of said second side contact elements being movable between a contact position and a non-contact position, each of said second side contact elements including a contact area and a wire connection means for making an electrical connection with a wire, said connector first side assembly and said connector second side assembly including connection means for connecting said first side assembly with said connector second side assembly in a mated position wherein individual said contact areas of said first side plurality of contacts make electrical contact with the corresponding individual said contact areas of said second plurality of electrical contacts for electrical connection of wires connected to said first side plurality of contacts of said first side base portion to wires connected to said second side plurality of contacts of said second side base element, said first side assembly and said connector second side assembly in said mated position defining an opening providing access to groups of said first side plurality of contacts in electrical contact with said second plurality of electrical contacts; and tap means insertable between said first side base portion and said second side base portion in said mated position for tapping signals carried by one or more of said first side plurality of contacts of said first first side base portion to one or more users connected to said tap means.

2. A connector according to claim 1, wherein said tap means includes wire connection means and contact portions, said contact portions making electrical contact with said one or more first side plurality of contacts, said tap wire connection means for connecting wires electrically to said contact portions.

3. A connector according to claim 2, wherein said connection means of each of said first contacts and said second contacts comprises an insulation displacement contact and said tap connection means comprises insulation displacement contacts.

4. A connector according to claim 2, wherein said first side plurality of contacts includes resilient means for supporting said contact area allowing said contact area to move between said contact position and said non-contact position.

5. A connector according to claim 1, further comprising contact displacement means for moving said first side plurality of contacts and said second side plurality of contacts between said contact position and said non-contact position.

6. A connector according to claim 5, wherein said contact displacement means includes a first contact opening device connected to said first base portion and in contact with ends of said first plurality of contacts, a second contact opening device connected to said second base portion and in contact with ends of said second plurality of contacts and a tip of said tap means, said first contact opening device and said second contact opening device for moving respectively said first side plurality of contacts and said second side plurality of contacts between said contact position and said non-contact position whereby said tip and side faces of said tap engage said first contact opening device and said second contact device for disengaging a contact between said contact area of said first side plurality of contacts and said contact area of said second side plurality of contacts.

7. A connector according to claim 1, further comprising:

a first side base portion connection means including a female connection part and a male connection part; and a second side base portion connection means including a second side base portion female part and a second side base portion male part, said first side base portion connection part and said second side base portion connection part for connecting said first connection assembly and said second connection assembly in said mated position.

8. A connector according to claim 1, wherein:

each of said first plurality of contacts is substantially identical to each of said second plurality of contacts; and said first first side base portion is substantially identical to said second first side base portion.

9. A connector according to claim 3, wherein said first side connector assembly further includes a strain relief element engaging said incoming wires for pressing said incoming wires to retain said incoming wires connected to said first side plurality of contacts of said connector first side assembly, said strain relief element including a snap connection element cooperating with a snap connection element of said first side base portion for fixing said strain relief element to said first side base portion.

10. A connector according to claim 9, wherein said connector first side assembly further includes assembly stacking connection means including a male connection element attached to said strain relief element and a female connection element defined by said first side base portion; and another connector first side assembly, said another connector first side assembly being connected to said connector first side assembly to form a first side stack of assemblies by connection of said connector first side assembly to said another connector first side assembly via said stacking connection means.

11. A connector according to claim 10, wherein said connector second side assembly further includes a second side strain relief element, said second side strain relief element being substantially identical to said first side strain relief element and said first side base portion being substantially identical to said second side base portion and further comprising:

another connector second side assembly, said another connector second side assembly being substantially identical to said connector fist side assembly; and second side assembly stacking connection means including a male connection element attached to said second side strain relief element and a female connection element defined by said second side base portion, said connector another second side assembly being stacked with said connector second side assembly to form a second side stack of assemblies via said second side assembly stacking means and wherein second side stack of assemblies is mated with said first side stack of assemblies.

12. A connector according to claim 11, wherein said first side stack of assemblies passes through to a first modular furniture piece and said second side stack of assemblies passes through to a second modular furniture piece.

13. A connector according to claim 3, wherein each of said first side plurality of contacts and said second side plurality of contacts are identical, each connector insulation displacement contact including a substantially U-shaped support defining a first wall and an opposite second wall, said first wall being connected to one insulation displacement contact portion and said second wall being connected to another, opposite insulation displacement contact portion, said U-shaped element being formed of resilient material for flexing to increase a distance between said first insulation displacement contact portion and said second insulation displacement contact portion allowing an insulated wire to be disposed between said first insulated displacement contact portion and said second insulated displacement contact portion for making contact with a wire core.

14. A telecommunications and data connector, comprising:

a connector first side assembly with a first side base portion formed of plastic and including a wire connection end and an opposite assembly connection end, a first side plurality of contact elements each of said contact elements being disposed on said first side base portion and extending from said wire end toward said assembly connection end, each of said first side contact elements being movable between a contact position and a non-contact position, each of said first side contact elements including a contact area and a wire connection means for making an electrical connection with a wire;

a connector second side assembly with a second side base portion formed of plastic and including a wire connection end and an opposite assembly connection end, a second side plurality of contact elements each of said contact elements being disposed on said second side base portion and extending from said wire end toward said assembly connection end, each of said second side contact elements being movable between a contact position and a non-contact position, each of said second side contact elements including a contact area and a wire connection means for making an electrical connection with a wire, said connector first side assembly and said connector second side assembly being connectable in a mated position wherein individual said contact areas of said first side plurality of contacts make electrical contact with the corresponding individual said contact areas of said second plurality of electrical contacts for electrical connection of wires connected to contacts at said wire end of said first side base element to wires connected to contacts at said wire end of said second side base element;

a first side base portion connection means including a female connection part and a male connection part;

a second side base portion connection means including a second side base portion female part and a second side base portion male part, said first side base portion connection part and said second side base portion connection part for connecting said first connection assembly and said second connection assembly; and contact displacement means for moving said first side plurality of contacts and said second side plurality of contacts between said contact position and said non-contact position while said connector first side assembly and said connector second side assembly are in the mated position and without moving said connector first side assembly and said connector second side assembly relative to one another.

15. A connector according to claim 14, further comprising tap means including an elongate element which may be inserted between the connector assemblies, one side of said elongate element is provided with a plurality of tap contacts and an opposite side is provided with an insulation material face.

16. A connector according to claim 15, wherein said contact displacement means includes a first contact opening device connected to said first base portion and in contact with ends of said first plurality of contacts, a second contact opening device connected to said second base portion and in contact with ends of said second plurality of contacts and a tip of said tap means, said first contact opening device and said second contact opening device for moving respectively said first side plurality of contacts and said second side plurality of contacts between said contact position and said non-contact position whereby said tip and side faces of said tap engage said first contact opening device and said second contact device for disengaging a contact between said contact area of said first side plurality of contacts and said contact area of said second side plurality of contacts when said tap is inserted between said first side base portion and said second side base portion.

17. A connector according to claim 14, wherein:

each of said first plurality of contacts is substantially identical to each of said second plurality of contacts; and said first side base portion is substantially identical to said second side base portion.

18. A connector according to claim 14, wherein said first side connector assembly further includes a strain relief element engaging said incoming wires for pressing said incoming wires to retain said incoming wires connected to said first side plurality of contacts of said connector first side assembly, said strain relief element including a snap connection element cooperating with a snap connection element of said first side base portion for fixing said strain relief element to said first side base portion, said strain relief element including a plurality of protruding elements for pressing corresponding incoming wires into IDC elements of said first plurality of contacts.

19. A connector according to claim 14, wherein said connector first side assembly further includes assembly stacking connection means including a male connection element attached to said strain relief element and a female connection element defined by said first side base portion; and another connector first side assembly, said another connector first side assembly being connected to said connector first side assembly to form a first side stack of assemblies by connection of said connector first side assembly to said another connector first side assembly via said stacking connection means, said connector second side assembly further including a second side strain relief element, said second side strain relief element being substantially identical to said first side strain relief element and said first side base portion being substantially identical to said second side base portion and further comprising:

another connector second side assembly, said another connector second side assembly being substantially identical to said connector fist side assembly; and second side assembly stacking connection means including a male connection element attached to said second side strain relief element and a female connection element defined by said second side base portion, said connector another second side assembly being stacked with said connector second side assembly to form a second side stack of assemblies via said second side assembly stacking means and wherein second side stack of assemblies is mated with said first side stack of assemblies.

20. A connector according to claim 14, wherein each of said first plurality of connectors and said second plurality of connectors are identical, each connector insulation displacement contact including a substantially U-shaped support defining a first wall and an opposite second wall, said first wall being connected to one insulation displacement contact portion and said second wall being connected to another, opposite insulation displacement contact portion, said U-shaped element being formed of resilient material for flexing to increase a distance between said first insulation displacement contact portion and said second insulation displacement contact portion allowing an insulated wire to be disposed between said first insulated displacement contact portion and said second insulated displacement contact portion for making contact with a wire core.

21. A telecommunications and data connector, comprising:

a connector first side assembly with a first side base portion formed of plastic and including a wire connection end and an opposite assembly connection end, a first side plurality of contact elements each of said contact elements being disposed on said first side base portion and extending from said wire end toward said assembly connection end, each of said first side contact elements being movable between a contact position and a non-contact position, each of said first side contact elements including a contact area and a wire connection means for making an electrical connection with a wire;

a connector second side assembly which is substantially identical to said connector first side assembly said connector first side assembly and said connector second side assembly being connectable in a mated position wherein individual said contact areas of said first side plurality of contacts make electrical contact with the corresponding individual contact areas of a second plurality of electrical contacts for electrical connection of wires connected to contacts at said wire end of said first side base element to wires connected to contacts at a wire end of a second side base element; and tap means including an elongate element which may be inserted between the connector assemblies, one side of said elongate element is provided with a plurality of tap contacts and an opposite side has an insulation material face, said tap means including disengagement means including said insulating material face for disengaging a contact area of said first side plurality of contacts and a contact area of said second side plurality of contacts as said tap is inserted between said first side base portion and said second side base portion in said mated position and for maintaining at least one of said second plurality of contacts in said non-contact position.

22. A connector according to claim 21, further comprising:

a first side base portion hermaphroditic connection means including a female connection part and a male connection part;

a second side base portion hermaphroditic connection means including a second side base portion female part and a second side base portion male part, said first side base portion connection part and said second first side base portion connection part for connecting said first connection assembly and said second connection assembly.

23. A connector according to claim 21, wherein each of said first side plurality of contacts and said second side plurality of contacts are identical, each connector insulation displacement contact including a substantially U-shaped support defining a first wall and an opposite second wall, said first wall being connected to one insulation displacement contact portion and said second wall being connected to another, opposite insulation displacement contact portion, said U-shaped element being formed of resilient material for flexing to increase a distance between said first insulation displacement contact portion and said second insulation displacement contact portion allowing an insulated wire to be disposed between said first insulated displacement contact portion and said second insulated displacement contact portion for making contact with a wire core.

* * * * *